United States Patent [19]

Barker

[11] Patent Number: 4,533,135

[45] Date of Patent: Aug. 6, 1985

[54] JAMMED SHEET REMOVAL AID IN A REPRODUCING MACHINE

[75] Inventor: Laurence S. Barker, Fairport, N.Y.

[73] Assignee: Xerox Corporation, Stamford, Conn.

[21] Appl. No.: 518,585

[22] Filed: Jul. 29, 1983

[51] Int. Cl.[3] ..... B65H 5/02

[52] U.S. Cl. ..... 271/275; 271/273; 271/277

[58] Field of Search ..... 271/272, 273, 274, 275, 271/276, 277, 198; 355/3 SH, 14 SH

[56] References Cited

U.S. PATENT DOCUMENTS

| | | | |
|---|---|---|---|
| 2,627,969 | 2/1953 | Darner et al. | 271/274 X |
| 3,603,680 | 9/1971 | Barton | 355/3 R X |
| 3,606,307 | 9/1971 | Herman | 271/275 |
| 3,819,266 | 6/1974 | Price | 355/64 |
| 3,937,454 | 2/1976 | Colwill | 271/272 X |
| 4,017,169 | 4/1977 | Komura et al. | 271/273 X |
| 4,116,556 | 9/1978 | Tanaka et al. | 271/273 X |
| 4,335,950 | 6/1982 | Gunzelman et al. | 271/273 X |

FOREIGN PATENT DOCUMENTS 2104490 3/1983 United Kingdom .

OTHER PUBLICATIONS

Brown, G. B. "Paper Transport and Jam Clearance", Xerox Disclosure Journal, vol. 18, No. 1, Jan./Feb. 1983, p. 25.

*Primary Examiner*—Bruce H. Stoner, Jr.
*Assistant Examiner*—James E. Barlow
*Attorney, Agent, or Firm*—H. Fleischer; J. E. Beck; R. Zibelli

[57] ABSTRACT

In a reproducing machine having copy sheets advancing through a processor to have information recorded thereon, it is necessary to be readily able to remove jammed sheets therefrom. A display on the reproducing machine indicates to the operator when a jam occurs. In response to the occurrence of a jam, all of the sheets in the processor are automatically freed from their respective sheet transports. In this way, the operator may readily remove the jammed sheet from the respective transport.

4 Claims, 4 Drawing Figures

JAMMED SHEET REMOVAL AID IN A REPRODUCING MACHINE

This invention relates generally to a reproducing machine, and more particularly concerns an apparatus for readily securing and releasing copy sheets to the respective transports therein to facilitate the freeing of a jammed copy sheet.

A typical reproducing machine utilizes the process of electrophotographic printing wherein a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In commercial reproducing machines of the foregoing type, the copy sheet is transported from a supply thereof through the printing machine processor and finally to an output station for removal by the printing machine operator. Various transports advance the copy sheet through the processor from the supply stack thereof to the output station. As the copy sheet passes along these transports, occasionally a jammed sheet may result. The reproducing machine will automatically indicate on a display that the jam has occurred. This will notify the machine operator of the jam. The operator will then open the door of the printing machine and attempt to remove the jammed copy sheet. As the processing speeds of reproducing machines increase, the importance of rapidly removing a jammed sheet therefrom becomes more important. Thus, it is desirable to be capable of removing the jammed sheet from the responding machine in the shortest possible time. However, the copy sheets are secured to the transport. Hence, it would be highly desirable to automatically release the copy sheets from the transport as the operator opens the door of the reproducing machine and, to automatically re-secure the copy sheets to the transport after the jammed sheet is removed therefrom. Various approaches have been devised to protect reproducing machines from jammed copy sheets. The following disclosures appear to be relevant to copy sheet jam clearance:

U.S. Pat. No. 3,603,680; Patentee: Barton; Issued: Sept. 7, 1971.

U.S. Pat. No. 3,819,266; Patentee: Price; Issued: June 25, 1974.

Xerox Disclosure Journal; Vol. 8, No. 1; January/-February 1983, Author: Brown.

The pertinent portions of the foregoing disclosures may be briefly summarized as follows:

Barton discloses an ultrasonic detection device located along the sheet transport to sense when a sheet jam occurs in an electrophotographic printing machine.

Price describes a control system which prevents the actuation of a reproducing machine until the jammed copy sheet is removed therefrom.

Browne discloses a sheet transport for an electrophotographic printing machine which includes a plurality of spaced endless belts entrained about a pair of opposed spaced rollers. Metal strips mounted pivotably on a transport frame are disposed above the belt. A copy sheet passes between the strips and the belts. An electromagnet is disposed interiorly of the belts. When the electromagnet is actuated, the strips are attracted thereto. The strips exert a normal force on the copy sheet securing the sheet to the belts. The magnetic attraction between the magnet and the strips varies as a function of the current exciting the electromagnet. In the event of a copy sheet jam or a printing machine malfunction, the electromagnet is deenergized minimizing the normal force to facilitate removal of the copy sheet from the belts.

In accordance with one aspect of the features of the present invention, there is provided a reproducing machine of the type having a source of sheet-like material, a processor disposed interiorly thereof for recording information on the sheet-like material, an output station for receiving the sheet-like material after the information has been recorded thereon, and a transport for advancing the sheet-like material from the source thereof through the processor to the output station. Means are provided for securing the material to the transport. Means de-energize the securing means to release the material from the transport to permit the ready removal of the material from the transport.

Pursuant to another aspect of the features of the present invention, there is provided a sheet transport having means, disposed interiorly thereof, for advancing sheet-like material. Means are provided for securing the material to the advancing means. Mean de-energize the securing means to release the material from the advancing means to permit the ready removal of the material from the transport.

Other aspects of the invention will become apparent as the following description proceeds and upon reference to the drawings in which.

While the present invention will hereinafter be described in connection with the preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
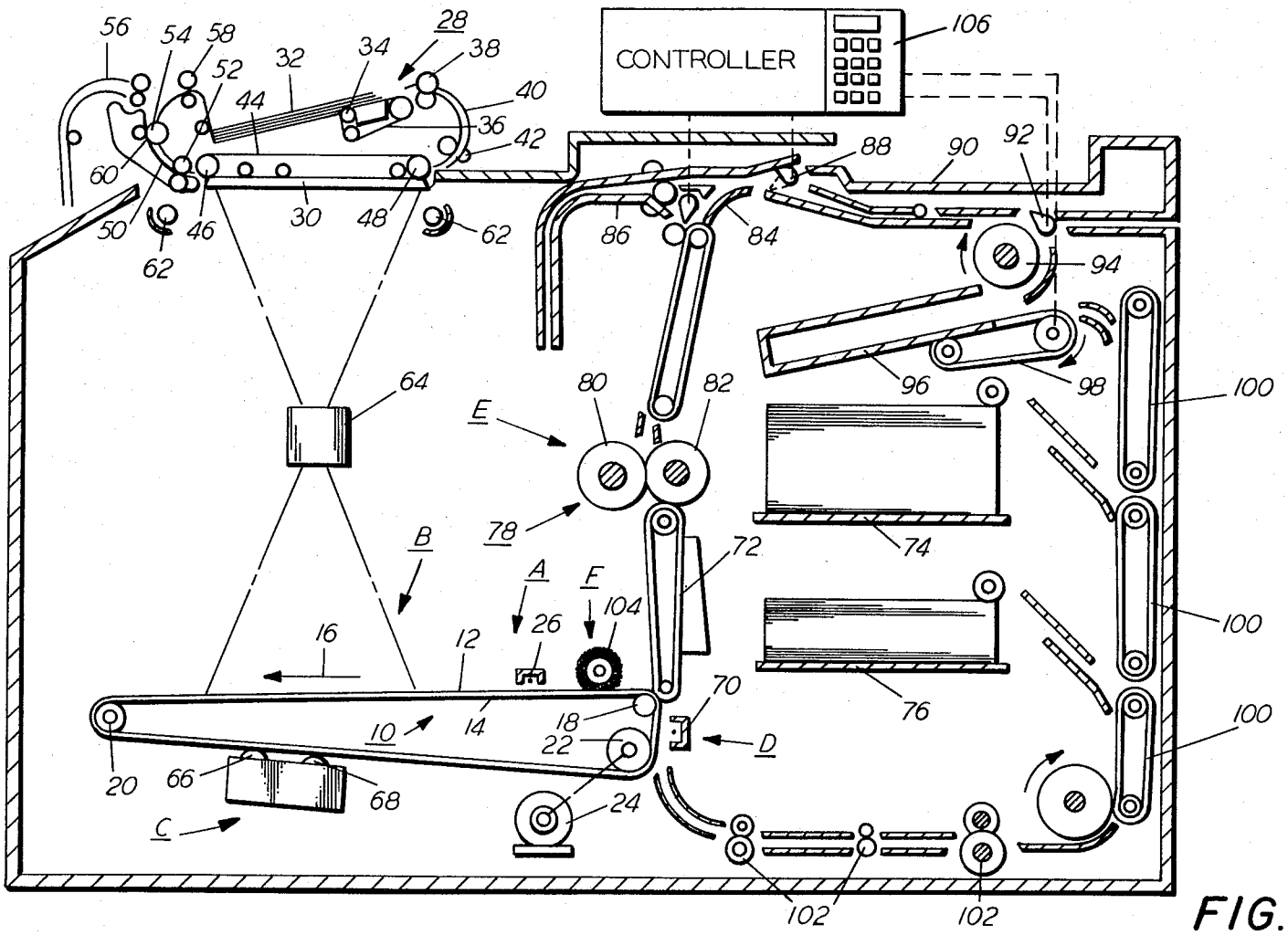
FIG. 1 is a schematic elevational view depicting an electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the copy sheet jam access system of the present invention therein. As illustrated hereinafter, this system may be employed in both a document handling unit and a copy sheet transport. It will become evident from the following discussion that the jam access system is equally well suited for use in a wide variety of printing machines, and is not necessarily limited in its application to the particular printing machine shown herein.

Inasmuch as the art of electrophotographic is well known, the various processing stations employed in the FIG. 1 printing machine will be shown hereinafter schematically and their operation described briefly with reference thereto.

As shown in FIG. 1, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy. Other suitable photoconductive materials and conductive substrates may also be employed. Belt 10 moves in the direction of arrow 16 to advance successive portions of photoconductive surface 12 sequentially through the various processing stations disposed about the path of movement thereof. Belt 10 is entrained about a stripping roller 18, tensioning roller 20 and drive roller 22. Stripping roller 18 is mounted rotatably so as to rotated with the movement of belt 10. Tensioning roller 20 is resiliently urged against belt 10 to maintain belt 10 under the desired tension. Drive roller 22 is rotated by motor 24 coupled thereto by suitable means such as a drive belt. As roller 22 rotates, it advances belt 10 in the direction of arrow 16.

Initially, a portion of the photoconductive surface passes through charging station A. At charging station A, a corona generating device, indicated generally by the reference numeral 26, charges photoconductive surface 12 to a relatively high, substantially uniform potential.

Next, the charged portion of photoconductive surface 12 is advanced through imaging station B. At imaging station B, a document handling unit, indicated generally by the reference numeral 28, is positioned over platen 30 of the printing machine. Document handling unit 28 sequentially feeds documents from a stack 32 of documents placed by the operator facedown in a normal forward collated order in a document stacking and holding tray 34. A document feeder 36 located below tray 34 forwards the bottom document in the stack to a pair of take away rollers 38. The bottommost sheet is then fed by rollers 38 through document guide 40 to feed roll pair 42 and belt 44. Belt 44 is entrained about a pair of opposed spaced rollers 46 and 48, respectively. After imaging, the original document is fed from platen 30 by belt 44 into guide 50 and feed roll pairs 52 and 54. The document then advances into an inverter mechanism, indicated generally by the reference numeral 56, or back to the document stack through feed roll pair 58. Decision gate 60 is provided to divert the document either to the inverter or to feed roll pair 58. Imaging of a document on platen 30 is achieved by lamps 62 which illuminate the document positioned thereon. Light rays reflected from the document are transmitted through lens 64. Lens 64 focuses the light image of the original document onto the charged portion of the photoconductive surace of belt 10 to selectively dissipate the charge thereon. This records an electrostatic latent image on the photoconductive surface which corresponds to the informational areas contained within the original document. Therafter, belt 10 advances the electrostatic latent image recorded on the photoconductive surface to development station C. The jam accessing system of the present invention may be utilized in document handling 28 to facilitate the removal of jammed original documents therein. The detailed structure of the jam access system for the copy sheet transport will be described hereinafter with reference to FIGS. 2 through 4, inclusive.

With continued reference to FIG. 1, at development station C, a pair of magnetic brush developer rollers, indicated generally by the reference numerals 66 and 68, advance developer material into contact with the electrostatic latent image. The latent image attracts toner particles from the carrier granules of the developer material to form a toner powder image on the photoconductive surface of belt 10.

Belt 10 then advances the toner powder image to transfer station D. At transfer station D, a copy sheet is moved into contact with the powder image. Transfer station D includes a corona generating device 70 which sprays ions onto the back side of the copy sheet. This attracts the toner powder image from photoconductive surface 12 of belt 10 to the sheet. After transfer, conveyer 72 advances the sheet to fusing station E.

The copy sheets are fed from a selected one of the trays 74 or 76 to transfer station D. After transfer of the toner powder image to the first side of the copy sheet, the sheet is advanced by conveyor 72 to fusing station E.

Fusing station E includes a fuser assembly, indicated generally by the reference numeral 78, which permanently affixes the transferred powder image to the copy sheet. Preferably, fuser assembly 78 includes a heated fuser roller and a back-up roller 82. The sheet passes between fuser roller 80 and back-up roller 82 with the powder image contacting fusing roller 80. In this manner, the powder image is permanently affixed to the copy sheet.

After fusing, the copy sheets are fed to gate 84 which functions as an inverter selector. Depending upon the position of gate 84, the copy sheets will be deflected into a sheet inverter 86 or bypass inverter 86 and be fed directly to a second decision gate 88. The sheets which bypass inverter 86 turn a 90° corner in the sheet path before reaching gate 88. Gate 88 inverts the sheets into a face up orientation so that the image side, which has been transferred or fused, is face up. If inverter path 86 is selected, the opposite is true, i.e. the last printed side is facedown. The second decision gate 88 either deflects the sheet directly into an output tray 90 or deflects the sheets into a transport path which carries them on without inversion to a third decision gate 92. Gate 92 either passes the sheets directly on without inversion into the output path of the copier, or deflects the sheets onto a duplex inverter roll 94. Roll 94 inverts and stacks the sheets to be duplexed in the duplex tray 96 when gate 92 so directs. Duplex tray 96 provides intermediate or buffer storage for those sheets which have been printed on one side on which an image will be subsequently printed on the side opposed thereto, i.e. the sheets being duplexed. Due to sheet inverting by roller 94, these buffer sheets are stacked in tray 96 facedown. They are stacked in duplex tray 96 on top of one another in the order in which they are copied.

In order to complete duplex copying, the simplex sheets in tray 96 are fed in seriatim by bottom feeder 98 from tray 96 back to transfer station D for transfer of the toner powder image to the opposed side of the copy sheet. Conveyors 100 and rollers 102 advance the sheet along the path which produces an inversion thereof. However, inasmuch as the bottommost sheet is fed from duplex tray 96, the proper or clean side of the copy sheet is positioned in contact with belt 10 at transfer station D so that the toner powder image is transferred thereto. The duplex trays are then fed through the same path as the simplex sheets to be stacked in tray 90 for subsequent removal by the printing machine operator. Conveyors or transports 100 are described in greater detail in FIG. 3. As depicted thereat, the transports 100 include a plurality of spaced endless belts entrained about a pair of opposed rollers. Each belt has a metal strip in juxtaposition therewith. The jam access system of the present invention is operatively coupled thereto. Thus, when the operator opens the the door of the electrophotographic printing machine to free a sheet jam, the strips are automatically spaced from the belt permitting the ready removal of the jammed sheet therefrom. In contradistinction, when the operator closes the door of the printing machine, the strips are automatically positioned to secure the copy sheet to the belt.

With continued reference to FIG. 1, invariably after the copy sheet is separated from photoconductive surface 12 of belt 10, some residual particles remain adhering thereto. These residual particles are removed from photoconductive surface 12 at cleaning station F. Cleaning station F includes a rotatably mounted fibrous brush 104 in contact with photoconductive surface 12 of belt 10. The particles are cleaned from photoconductive surface 12 of belt 10 by the rotation of brush 101 in contact therewith. Subsequent to cleaning, a discharge lamp (not shown) floods photoconductive surface 12 with light to dissipate any residual electrostatic charge remaining thereon prior to the charging thereof for the next successive imaging cycle.

Controller 106 is preferably a programmable microprocessor which controls all the machine functions hereinbefore described. The controller provides the storage and comparison of counts of the copy sheets, the number of documents being recirculated in the document sets, the number of copy sheets selected by the operator, time delays, jam correction control, etc. The control of all the exemplary systems hereintofore described may be accomplished by conventional control switch inputs from the printing machine console selected by the operator. Conventional sheet path sensors or switches may be utilized for counting or keeping track of the position of the document and copy sheets. If the sensor indicates that a copy sheet has been located in a given position on one of the copy sheet transports for a prolonged period of time, i.e. in excess of the preselected time period, controller 106 will actuate a display indicating a jammed sheet. The controller will then shut the printing machine down preventing further copies from being made thereon. At this time, the operator must now open the printing machine door in order to gain access to the jammed copy sheet. The jam access system of the present invention will automatically space the strips holding the copy sheet to the conveyor belt therefrom permitting the ready access to the jammed copy sheet by the operator. The detailed structure of the jam access system will be described hereinafter with reference to FIGS. 2 through 4, inclusive.

It is believed that the foregoing description is sufficient for purposes of the present application to illustrate the general operation of an electrophotographic printing machine incorporating the features of the present invention therein.

Referring now to the specific subject matter of the present invention, the general operation of the jam access system will be described hereinafter with reference to FIGS. 2 through 4, inclusive.

Figure 2:
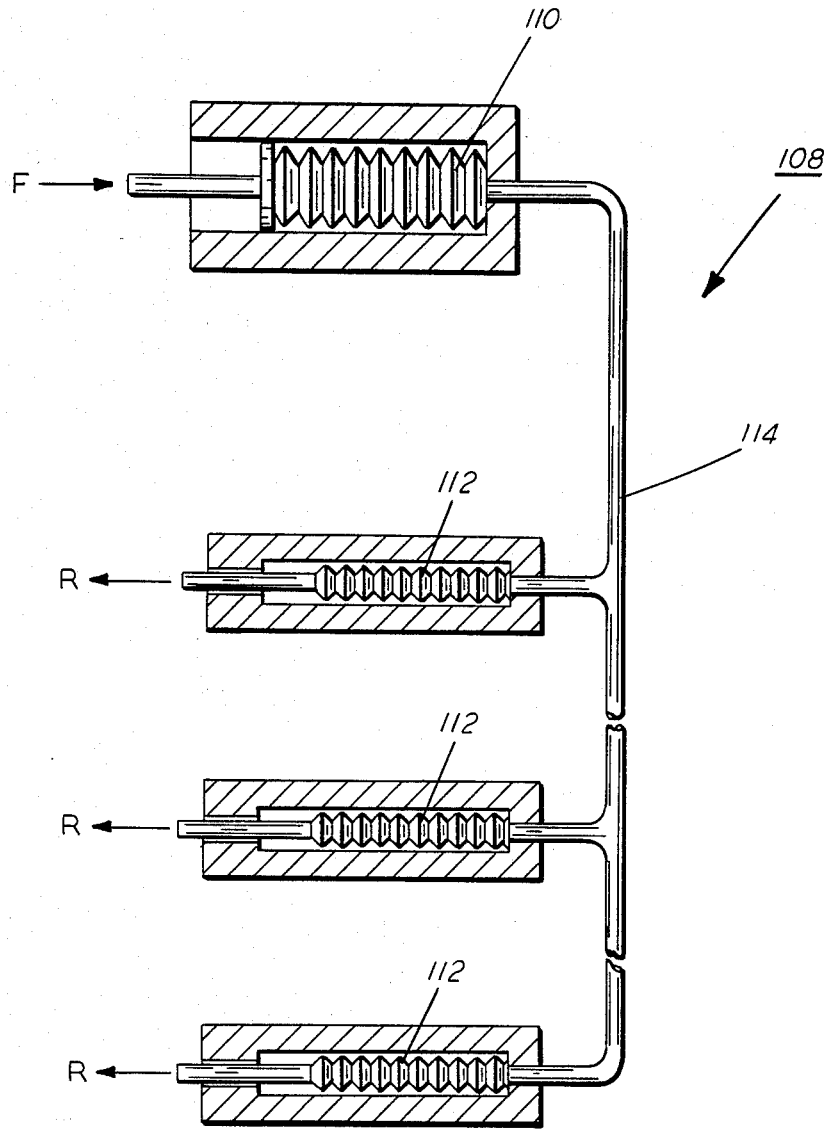
FIG. 2 is a fragmentary sectional view depicting the pneumatic system controlling access to the copy sheets being transported in the printing machine of FIG. 1.

As shown in FIG. 2, the jam access system comprises a pneumatic system indicated generally by the reference numeral 108. Pneumatic system 108 comprises a reservoir 110 coupled to actuators 112 via conduits 114. Reservoir 110 and actuators 112 are bellows. Pneumatic system 108 is a closed system with air being the fluid contained therein. Thus, reservoir bellows 110 and actuator bellows 112 are air filled. In operation, if a force, F, is applied to reservoir bellows 110, reservoir bellows 110 is compressed causing air to be expelled therefrom through conduit 114 to actuator bellows 112. This increases the air in actuator bellows 112 causing actuator bellows 112 to expand resulting in their respective rods exerting a reaction force, R, which is in the opposite direction to force F. In contradistinction, when force F is removed from reservoir bellows 110, bellows 110 returns to its normal position and air is withdrawn from actuator bellows 112 which, in turn, return to their normal unextended position. In operation, bellows 110 is positioned closely adjacent to the door of the printing machine with actuator bellows 112 being positioned so as to control the movement of the strips on the respective sheet transports. Thus, when the printing machine door is closed, the force F is exerted on reservoir bellow 110 causing air to be expelled therefrom resulting in actuator bellows 112 expanding and producing a reaction force R on the strips to position the strips closely adjacent to the respective belts securing the copy sheets thereto. However, when controller 106 indicates that a jam has occurred, the machine operator opens the door removing force F from reservoir bellows 110. At this time, reservoir bellows 110 returns to its normal, uncompressed position and air flows from actuator bellows 112 thereto through conduit 114. As air leaves actuator below 112, these bellows return to their normal unextended position removing the reaction force, R, from the strips. The strips, in turn, are resiliently urged by springs to a position spaced from the belts. In this way, the machine operator may readily remove the jammed copy sheet from the transport.

Figure 3:
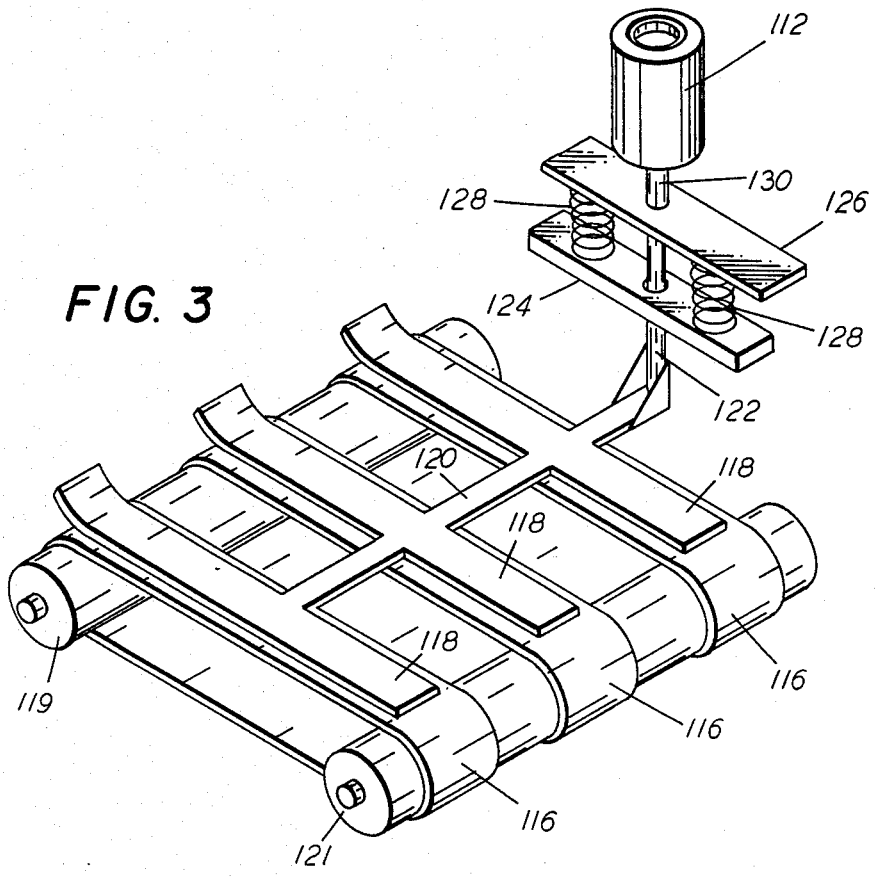
FIG. 3 is a fragmentary perspective view illustrating a portion of the FIG. 2 pneumatic system controlling the sheet transport to secure and release copy sheets therefrom.

Turning now to FIG. 3, there is shown the operation of the actuator bellows in association with one of the transports 100 of the FIG. 1 printing machine. As shown, transport 100 comprises a plurality of endless belts 116 entrained about a pair of opposed spaced rollers 119 and 121. One of the rollers, e.g. roller 119, is driven by a motor (not shown) to move belts 116. The other roller, e.g. roller 121, is an idler and rotates freely. Each belt 116 has a metal strip 118 in juxtaposition therewith. Strips 118 are connected to one another by connecting strip 120. A rod 122 is secured to connecting strip 120 and extends in a direction substantially perpendicular thereto. Rod 122 has a flange 124 extending outwardly therefrom. Flange 124 is connected to the printing machine frame 126 by springs 128. Rod 130 of actuator bellow 112 is in contact with the free end portion of rod 122. Springs 128 resiliently pull on flange 124 in an upwardly direction. Thus, when springs 128 are in their normal unextended position, strips 118 are spaced from the copy sheet and belt 116 permitting the ready removal of the copy sheet therefrom. However, when the printing machine door is closed, reservoir bellows 110 compress and actuator bellows 112 expands. As actuator bellows 112 expands, rod 130 moves in a downwardly direction exerting a force on rod 122 opposing the spring force exerted thereon forcing strips 118 in a downwardly direction to secure the copy sheet to belts 116. It is, thus, clear that the movement of rod 130 of actuator 112 is controlled by the expansion and contraction of the bellows thereof. This in turn, is controlled by the opening and closing of the printing machine door.

Figure 4:
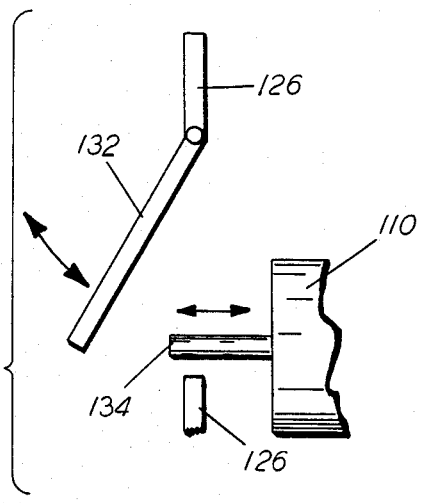
FIG. 4 is a fragmentary, schematic elevational view depicting the door of the copying machine and its interaction with a portion of the FIG. 2 pneumatic system.

Referring now to FIG. 4, there is shown the detailed operation of the printing machine door in association with reservoir bellows 110. As depicted thereat, door 132 is shown in the opened position. Door 132 is mounted pivotably on the printing machine frame 126. In this position, i.e. when door 132 is opened, reservoir bellows 110 remains uncompressed and there is no force exerted on rod 134 thereof. Thus, springs 124 resiliently urge strips 118 away from belts 116. In contradistinction, when door 132 is closed, a force is exerted on rod 134 compressing reservoir bellows 110 causing air or fluid to be expelled thereform through conduit 114 into actuator bellows 112. This causes actuator bellows 112 to expand moving rod 130 in a direction such as to exert a force on rod 122 in a direction opposed to that of the force exerted thereon by springs 128. Rod 122 moves in a downwardly direction extending springs 128. When the force exerted by springs 128 balances the force exerted by bellows 112, movement ceases. At this position, strips 118 secure the copy sheet to belts 116. When a jam is indicated, door 132 is opened removing the force on rod 134 of reservoir bellows 110 which, in turn, now returns to its normal uncompressed position and air returns therein. As the air returns to reservoir bellows 110, actuator bellows 112 return to their normally unextended position. This permits springs 128 to resiliently urge rod 122 to move in an upwardly direction so as to space strips 118 from belts 116 enabling the operator to easily remove the jammed copy sheet therefrom.

One skilled in the art will appreciate that a compressor may be employed instead of reservoir bellows 110. In this embodiment, actuation of the compressor causes air to flow through conduit 114 expanding actuator bellows 112 so as to move strips 118 to a position securing the copy sheet on belts 116. When controller 106 detects a jam, the compressor is de-energized. This causes actuator bellows 112 to return to an unextended position spacing strips 118 from the copy sheet. After the jammed sheet is removed from the printing machine, the "Start Print" button is pressed. This re-starts the compressor securing the copy sheets to their respective belts. Alternatively, the compressor may be de-energized in response to the operator opening the door to the printing machine and energized in response to the door being closed.

In recapitulation, it is evident that the jam access system of the present invention automatically permits the ready removal of the copy sheet from the sheet transport in response to the operator opening the printing machine door. One skilled in the art will appreciate that a similar system may be employed in the case of a document handling system. Thus, the opening of the document handling system in response to a document jam would also provide ready access to the jammed document facilitating the removal thereof from the document handling system.

It is, therefore, evident that there has been provided in accordance with the present invention an apparatus for facilitating the removal of jammed sheets from a printing machine. This apparatus fully satisfies the aims and advantages hereinbefore set forth. While this invention has been described in conjunction with various embodiments thereof, it is evident that many alternatives, modifications and variations would be apparent to those skilled in the art. Accordingly, it is intended to embrace all such alternatives, modifications and variations as fall within the spirit and broad scope of the appended claims.

What is claimed is:

1. A reproducing machine of the type having a source of sheet-like material, a processor disposed interiorly thereof for recording information on the sheet-like material, an output station for receiving the sheet-like material after the information has been recorded thereon, and a transport for advancing the sheet-like material from the source thereof through the processor to the output station, wherein the improvement includes:

means for accessing the interior of the reproducing machine;

means for advancing the material;

means for holding the material on said advancing means;

means, operatively coupled to said accessing means, for storing a supply of fluid therein, said storing means includes a storage bellows coupled to said accessing means so that closing of said accessing means compresses said storage bellows forcing fluid therefrom and opening said accessing means expands said storage bellows drawing fluid therein; and means, connected to said storing means, for moving said holding means to an operative position in response to said accessing means being closed and to an inoperative position spaced from said advancing means in response to said accessing means being opened.

2. A reproducing machine according to claim 1, wherein said moving means includes:

at least one conduit connected to said storage bellows;

at least one actuator bellows connected to said conduit so that said actuator bellows expands in response to said storage bellows compressing and compresses in response to said storage bellows expanding; and linkage means coupled to said actuator bellows for moving said holding means to the operative position in response to said actuator bellows expanding and to the inoperative position in response to said actuator bellows compressing.

3. A sheet transport, including:

means for accessing the interior of the sheet transport;

means, disposed interiorly of the transport, for advancing sheet-like material;

means for holding the material on said advancing means;

means, operatively coupled to said accessing means, for storing a supply of fluid therein, said storing means includes a storage bellows coupled to said accessing means so that closing of said accessing means compresses said storage bellows forcing fluid therefrom and opening said accessing means expands said storage bellows drawing fluid therein; and means, connected to said storing means, for moving said holding means to an operative position in response to said accessing means being closed and to an inoperative position in response to said accessing means being opened.

4. A transport according to claim 3, wherein said moving means includes:

at least one conduit connected to said storage bellows;

at least one actuator bellows connected to said conduit so that said actuator bellows expands in response to said storage bellows compressing and compresses in response to said storage bellows expanding; and linkage means coupled to said actuator bellows for moving said holding means to the operative position in response to said actuator bellows expanding and to the inoperative position in response to said actuator bellows compressing.

* * * * *